US005210525A

United States Patent [19]

Lennon et al.

[11] Patent Number: 5,210,525

[45] Date of Patent: May 11, 1993

[54] FLOATING KEY FINDER

[76] Inventors: Geoffrey B. Lennon, 38 Rhode Island Ave.; Scott C. Harvie, 35 Poplar St., both of Newport, R.I. 02840

[21] Appl. No.: 818,032

[22] Filed: Jan. 8, 1992

[51] Int. Cl.[5] ..... G08B 21/00

[52] U.S. Cl. ..... 340/604; 70/456 R; 362/116; 200/61.05; 340/693

[58] Field of Search ..... 340/603, 604, 693; 70/456 R; 362/116, 802; 200/61.04, 61.05; 116/107, 108, 202, 209, 210; 43/17, 17.1, 17.5

[56] References Cited

U.S. PATENT DOCUMENTS 4,81,636 11/1989 Oletzke ..... 70/456 R X 2,533,518 12/1950 Scott ..... 70/456 R

FOREIGN PATENT DOCUMENTS 3518062 11/1986 Fed. Rep. of Germany .

*Primary Examiner*—Jin F. Ng

*Assistant Examiner*—Jeffery A. Hofsass

*Attorney, Agent, or Firm*—H. Jay Spiegel

[57] ABSTRACT

A floating key finder is disclosed which includes a housing which is buoyant and has a key ring attached to the housing and designed to hold a plurality of keys. An electrical circuit is contained within the housing and includes a moisture sensing switch which is enclosed when immersed in liquid. Such immersion causes activation of a signal such as a flashing light, an audible horn or beeper, or both.

7 Claims, 1 Drawing Sheet

FLOATING KEY FINDER

BACKGROUND OF THE INVENTION

The present invention relates to a floating key finder. In the prior art, key holders made of a foam material are known. However, Applicants are unaware of any such device which combines buoyancy with an electrical circuit activated by immersion in water and which includes a signaling means.

The following prior art is known to Applicants:

U.S. Pat. No. 2,715,676 to Fore discloses a key holder which includes an electrical circuit including a battery and a light bulb. The present invention differs from the teachings of Fore as including both flotation structure and an automatic switch designed to activate the light bulb responsive to immersion in water.

U.S. Pat. No. 3,863,062 to Caron discloses a key holder with flashlight. Again, the present invention differs from the teachings of Caron as including flotation as well as an automatic switch which is closed responsive to immersion of the device in water.

U.S. Pat. No. 4,068,221 to McClintock discloses an immersion responsive sensor including a switch which is closed upon immersion in water and illumination means which is activated by such immersion. Of course, this patent fails to contemplate combining such structure with a floating key holder.

SUMMARY OF THE INVENTION

The present invention relates to a floating key finder. The present invention includes the following interrelated objects, aspects and features:

(a) In a first aspect, the present invention contemplates a housing which is fluid impervious and contains, in an internal chamber, buoyant materials such as, for example, foamed plastic, so that the housing may float in water. A battery chamber is provided at a lower portion of the housing and which contains a battery which is so located so that in combination with the buoyant material, the housing floats in an upright position with the battery below.

(b) On a lower end of the housing, an immersion responsive switch is mounted including two contacts with a small gap therebetween. When the housing is immersed in water, the gap between the contacts is filled with liquid thereby completing the connection and closing the immersion responsive switch.

(c) A master switch is provided as well as illumination means on an upper part of the housing designed to be activated when the immersion responsive switch is closed. The illumination means may flash if desired.

(d) Furthermore, a ring is mounted on the housing through a hole provided for that purpose. A plurality of keys may be removably fastened on the ring. Finally, if desired, an audible indicator may also be provided.

As such, it is a first object of the present invention to provide a floating key finder.

It is a further object of the present invention to provide such a device including a battery powered indicator which is activated in response to immersion of the housing in water.

It is a still further object of the present invention to provide audible and visual indicators in such a device.

It is a yet further object of the present invention to provide such a device which is portable and battery powered.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
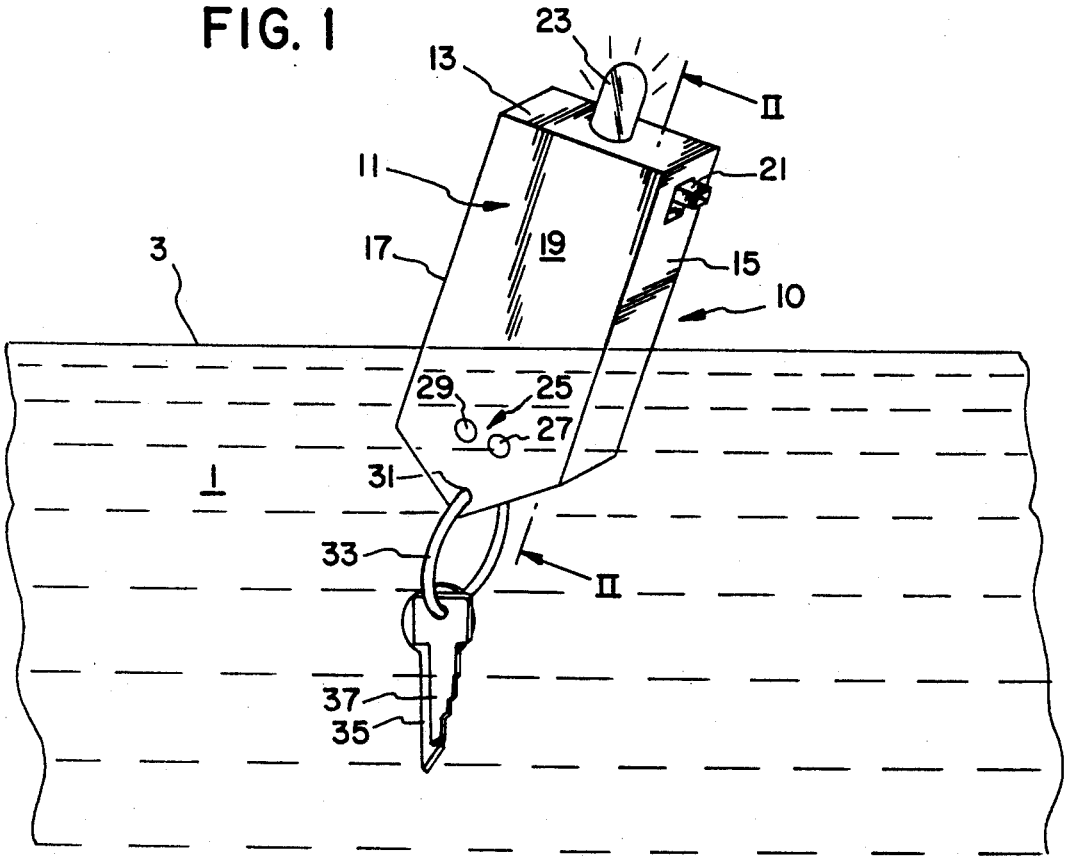
FIG. 1 shows a perspective view of the present invention.

With reference, first, to FIG. 1, a body of water is generally designated by the reference numeral 1 and includes a surface 3. The present invention is generally designated by the reference numeral 10 and is seen floating on the surface 3 of the body of water 1.

The device 10 includes a housing 11 having a top surface 13 and sides 15 and 17, with a front surface 19 being particularly shown in FIG. 1. On the top surface 13, a light bulb 23 is seen to protrude and the side wall 15 is seen to have an on-off switch 21 protruding outwardly therefrom. As should be understood by those skilled in the art, the switch 21 and light bulb 23 are mounted in the housing 11 in a manner preventing fluid from entering the interior of the housing 11.

As also shown in FIG. 1, a switch 25 is provided which, in the preferred orientation of the device 10 in the water 1, is immersed under the surface 3 thereof. The switch 25 includes closely spaced contacts 27 and 29. In the operation of the switch 25, when it is immersed in water as shown in FIG. 1, the conductivity of the water completes the circuit between the contacts 27 and 29, thereby "closing" the switch 25.

Also shown in FIG. 1 is a hole 31 extending through the housing 11 and sized to freely receive a ring 33 which holds a plurality of keys 35, 37.

Figure 2:
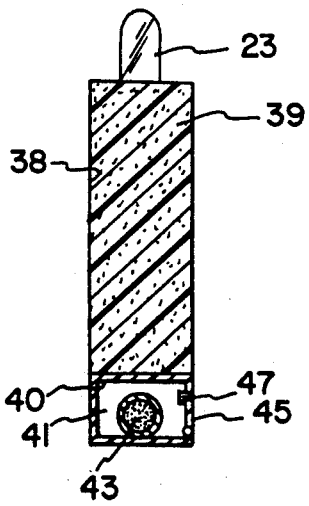
FIG. 2 shows a cross-sectional view along the line II—II of FIG. 1.

With reference to FIG. 2, it is seen that the housing 11 has a first internal chamber 38 which contains a flotation material 39 which may be a foamed plastic, foamed rubber, cork or other suitable flotation material. A partition 40 separates the chamber 38 from another chamber 41 which contains the battery 43 to which access is gained by opening the access door 45. Suitable sealing means 47 is provided to provide a watertight seal for the chamber 41.

Figure 3:
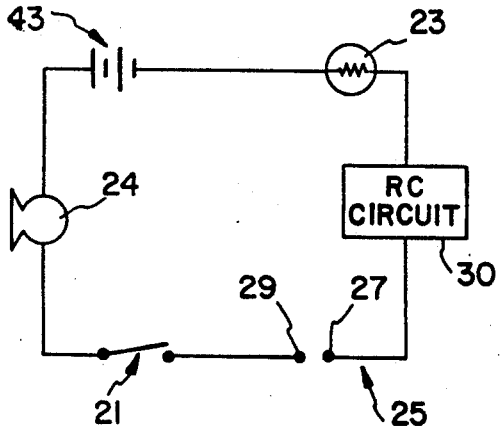
FIG. 3 shows a schematic representation of the electrical circuitry of the present invention.

FIG. 3 is a schematic representation of the electrical circuit of the present invention. Shown in FIG. 3 are the battery 43, the light bulb 23, the moisture responsive switch 25 and the on-off master switch 21.

Also shown in FIG. 3 are an RC circuit 30 designed to cause the light bulb 23 to flash as well as an audible indicator 24 which may be a horn or a beeper. Of course, the RC circuit 30 will cause the audible indicator 24 to operate intermittently as well.

In the operation of the present invention, the switch 21 is closed to activate the circuit best shown in FIG. 3. Under such circumstances, if the device 10 is accidentally dropped in water, it will float through the provision of the buoyant material 39 and due to the particular location of the buoyant material 39 and the battery 43 (acting also as a weight), will float in the orientation shown in FIG. 1. In this orientation, the switch 25 is immersed in the water 1 thereby closing the switch 25 and causing activation of the audible and visual indicators 24, 23 respectively. In this way, the location of the device 10 may easily be ascertained by its owner and it may be easily retrieved.

The housing 11 of the present invention is made of a fluid impervious material, preferably a hard plastic. The light bulb 23 may be incandescent or it may, if desired, comprise a light emitting diode of any desired color. The ring 33 is preferably made of a rust proof material such as, for example, stainless steel.

As such, an invention has been disclosed in terms of a preferred embodiment thereof, which fulfills each and every one of the objects of the invention as set forth hereinabove and provides a new and useful floating key finder of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A floating key finder, comprising:

a) a buoyant housing having means for holding at least one key thereon;

b) indicator means on said housing;

c) a circuit including moisture responsive switch means on said housing and electrically connected to said indicator means via a battery;

d) whereby when said finder is located in a body of water, said finder floats with said moisture responsive switch means immersed, thereby closing said switch means and activating said indicator means.

2. The invention of claim 1, whereby said housing has an internal chamber filled with a foamed material.

3. The invention of claim 1, wherein said indicator means comprises a light bulb.

4. The invention of claim 1, wherein said indicator means comprises a buzzer.

5. The invention of claim 1, wherein said moisture responsive switch means includes two closely spaced contacts mounted on said housing at a location thereon which is below a level of said body of water when said finder is located therein.

6. The invention of claim 1, further including a master on-off switch in said circuit.

7. A floating key finder comprising:

a) a housing having an internal chamber filled with a buoyant material;

b) a key ring releasably mounted on the housing;

c) an electrical circuit including a battery, a moisture responsive switch and an indicator light; and d) a flasher sub-circuit incorporated into said circuit to cause said light to flash when the moisture responsive switch is activated.

* * * * *